US005404986A

United States Patent [19]

Hossfield et al.

[11] Patent Number: 5,404,986

[45] Date of Patent: Apr. 11, 1995

[54] METHOD AND APPARATUS FOR DISCRIMINATING AND COLLECTING COINS

[75] Inventors: Robin C. Hossfield, Medway; Christopher Ferguson, Ashland, both of Mass.; J. Scott Petty, Cedar Rapids, Iowa; Glenn W. Schwantes, Oshkosh; William J. Quandt, Ripon, both of Wis.

[73] Assignee: Raytheon Company, Lexington, Mass.

[21] Appl. No.: 194,755

[22] Filed: Feb. 10, 1994

[51] Int. Cl.[6] ..... G07D 5/02; G07D 5/08

[52] U.S. Cl. ..... 194/317; 194/334; 194/343

[58] Field of Search ..... 194/317, 318, 319, 334, 194/342, 343; 453/3, 4, 57

[56] References Cited

U.S. PATENT DOCUMENTS

| | | | |
|---|---|---|---|
| 2,594,422 | 4/1952 | Gordon | 194/346 X |
| 3,870,137 | 3/1975 | Fougere . | |
| 3,952,851 | 4/1976 | Fougere . | |
| 3,966,034 | 6/1976 | Heiman et al. . | |
| 4,509,633 | 4/1985 | Chow | 194/334 |
| 4,646,904 | 3/1987 | Hoormann | 194/334 |

FOREIGN PATENT DOCUMENTS

| | | | |
|---|---|---|---|
| 2293749 | 7/1976 | France | 194/343 |
| 2236420 | 4/1991 | United Kingdom | 194/343 |

*Primary Examiner*—F. J. Bartuska
*Attorney, Agent, or Firm*—William R. Clark

[57] ABSTRACT

A method and apparatus for discriminating and collecting coins wherein an inserted coin is received in a notch of a rotary disk. Upon sensing the insertion of a coin into the notch, a motor rotates the disk through a predetermined arc to a predetermined angular orientation where a decision is made whether to accept or reject the coin based on coin characteristics such as the sensed diameter of the coin and metal content. If the coin is accepted, the disk is rotated to an angular orientation where the coin falls from the notch into a coin collection box. However, if the coin is rejected, the disk is rotated in the opposite direction to an angular orientation where the coin falls into a coin return chute. Sensors are also provided to sense the presence of the coin in the notch on the way back to the initial angular orientation. If the coin failed to fall out for any reason, another attempt is made to collect the coin. If still unsuccessful, a fault is indicated, and the apparatus remains in an inoperative state. Removal of the coin from the coin return chute is also sensed before another coin can be inserted.

20 Claims, 8 Drawing Sheets

METHOD AND APPARATUS FOR DISCRIMINATING AND COLLECTING COINS

BACKGROUND OF THE INVENTION

The field of the invention generally relates to coin operated devices, and more particularly relates to apparatus and methods for discriminating and collecting coins.

As is well known, there are a variety of coin operated devices such as laundromat equipment, vending machines, toll booths, and public telephones. Generally, such devices identify a deposited coin or token by detecting coin characteristics or parameters, and then comparing them to corresponding standards that are known for acceptable coins of different denominations. For example, some of these parameters are coin diameter, thickness, ferrous content, and weight.

Some of the more successful coin discrimination schemes employ a combination of parameters such as coin diameter discrimination combined with sensing the metal characteristics of the coin. For example, a typical prior art coin diameter discriminating device may employ some sensor to detect the passing of a rolling coin. In particular, one or more optical sensors maybe arranged along a ramp along which the coin rolls. The diameter is then determined by measuring the time required for the coin to pass the sensors. When only one sensor is used, the device may discriminate the diameter of a coin on the basis of the time during which light from an emitter is shielded from a photodetector by the coin passing therebetween. It is apparent that when suitably arranged, a large coin will break the light beam for a longer period of time than a small coin. Thus, the measured time is related to the size or diameter of the coin. The measured time is then compared to ranges of times derived from a data bank of measurements made on a variety of acceptable coins. A metal content measurement can be made such as described in U.S. Pat. No. 3,966,034, and in like manner the measured data can be compared to corresponding ranges for acceptable coins. If a received coin falls in all of the ranges for a particular coin denomination, the coin maybe accepted as being a genuine coin of that denomination. Under such condition, an accumulator is generally incremented, and the coin is routed to a coin collection box rather than to a coin return slot.

There are a number of disadvantages with prior art coin discriminating and collecting devices. First, coin entry slots are generally left open so additional coins may be inserted while evaluation of a previously inserted coin is still being conducted. Such action may interfere with the present evaluation and/or the coins may become jammed. Further, once jammed, there generally is no way to correct the anomaly until a service technician opens the mechanism. Another problem is that coin discrimination and collection devices are often susceptible to tampering or being cheated. For example, one technique is to insert implements into the coin slot. In another technique called stringing, the coin is retrieved using a string or wire after the coin's value has been accumulated.

SUMMARY OF THE INVENTION

In accordance with the invention, a coin discriminating and collecting apparatus includes a rotary disk having a notch adapted for receiving a coin inserted by a user when the disk is in an initial angular orientation. Once insertion of the coin in the notch is detected, a motor rotates the disk in a first direction through a predetermined arc. Means are provided for either accepting or rejecting the coin. If the coin is accepted, the disk is rotated further in the first direction to an angular orientation where the notch opens downwardly above a coin collection path to enable the coin to fall into a coin collection box. However, if the coin is rejected, the disk is rotated in the opposite direction to an angular orientation where the notch opens downwardly above a coin return chute to enable the coin to fall into the chute to be returned to the user.

It is preferable to include means for generating a signal corresponding to the diameter of the coin, and for comparing the signal to corresponding signals representative of acceptable coins. In response thereto, a determination is made whether to accept or reject the coin. In a preferred arrangement, the predetermined arc from the initial orientation is approximately 90°. It is also preferable to include a metal content sensor to generate a signal to be compared to a range of corresponding signals representative of acceptable coins, and then to base the acceptance/rejection determination on this comparison also. From the coin collection orientation, the disk is preferably rotated in the first direction back to the initial angular orientation past a detector that determines whether the inserted coin is still disposed in the notch. If the coin is still present, that is generally indicative that it is jammed or stuck in that position, and the disk is rotated back to the angular orientation of the coin collection path in an attempt to dislodge the coin again. If dislodging is still unsuccessful, a fault is indicated, and the disk is not returned to its initial angular orientation. A detector may also be provided at the coin return chute so that, after rejection of a coin, the disk is not returned to the initial angular orientation until the user removes the rejected coin.

With such arrangement, the notch of the disk is rotated away from the input slot of the apparatus after the coin is initially inserted so the outer periphery of the disk covers the insertion slot. Therefore, insertion of additional coins during the entire evaluation and coin collecting processes are prevented. Thus, the potential for associated jamming problems is eliminated. Further, if a coin is stuck in the notch for some reason such as a sticky substance on its edge, the disk is rotated back to the coin collection path in an attempt to dislodge the coin. Thus, there is some measure of automatic jam clearing capability. Further, because the coin is carried in a rotary mechanism, stringing is ineffective for retrieving an accumulated coin; the disk is between the insertion slot and the coin in the initial stages, and if the coin is retained in the notch after it arrives at the coin collection path, the notch is not returned to alignment with the insertion slot. Thus, there is no opportunity to pull the coin back out. Further, the edge or periphery of the disk in front of the insertion slot prevents implements from being inserted into the coin path during operation.

BRIEF DESCRIPTION OF THE DRAWINGS

The foregoing objects and advantages will be more fully understood by reading the following Description of the Preferred Embodiment with reference to the drawings wherein.

DESCRIPTION OF THE PREFERRED EMBODIMENT

Figure 2:
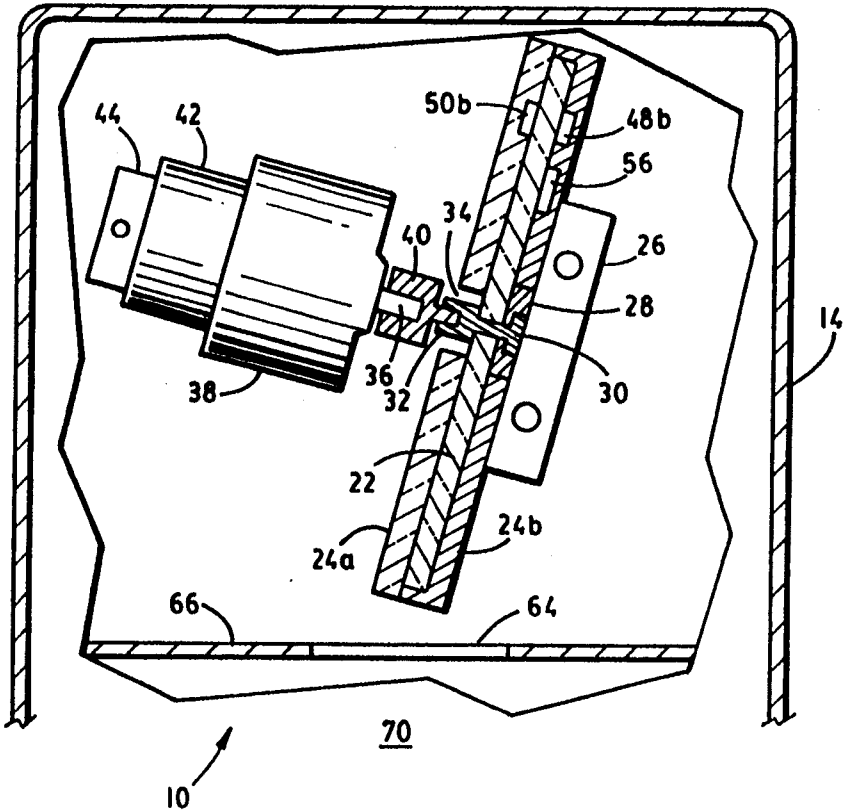
FIG. 2 is a front view of the coin transport mechanism of FIG. 1.
Figure 1:
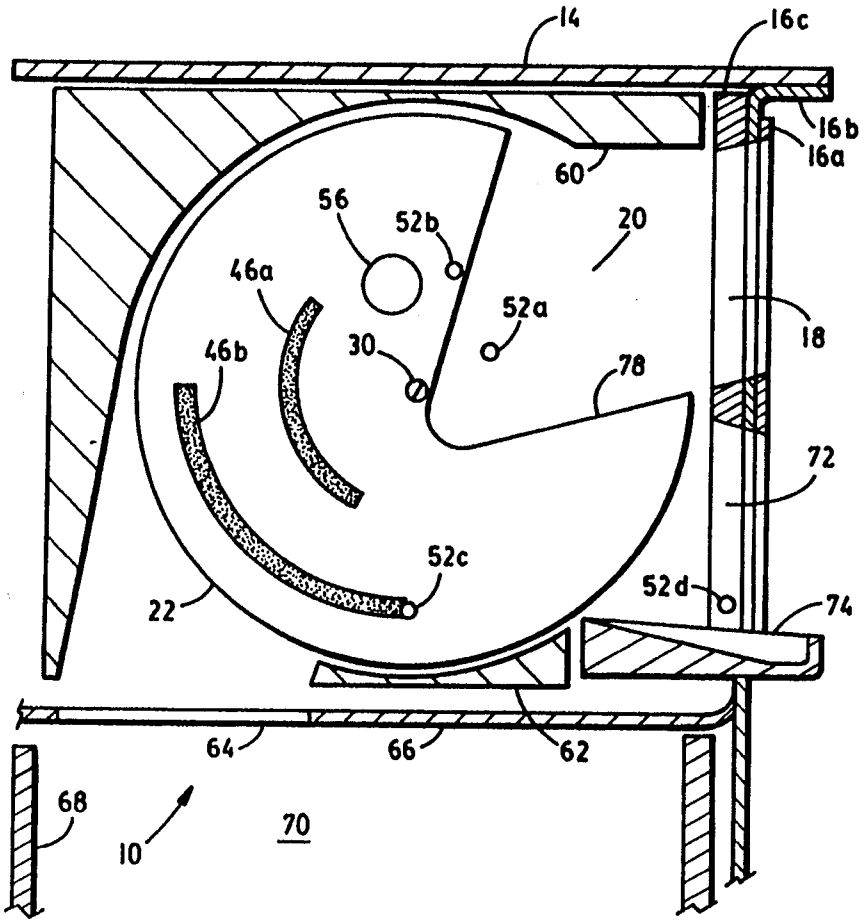
FIG. 1 is a partially sectioned side view of a coin transport mechanism.
Figure 3:
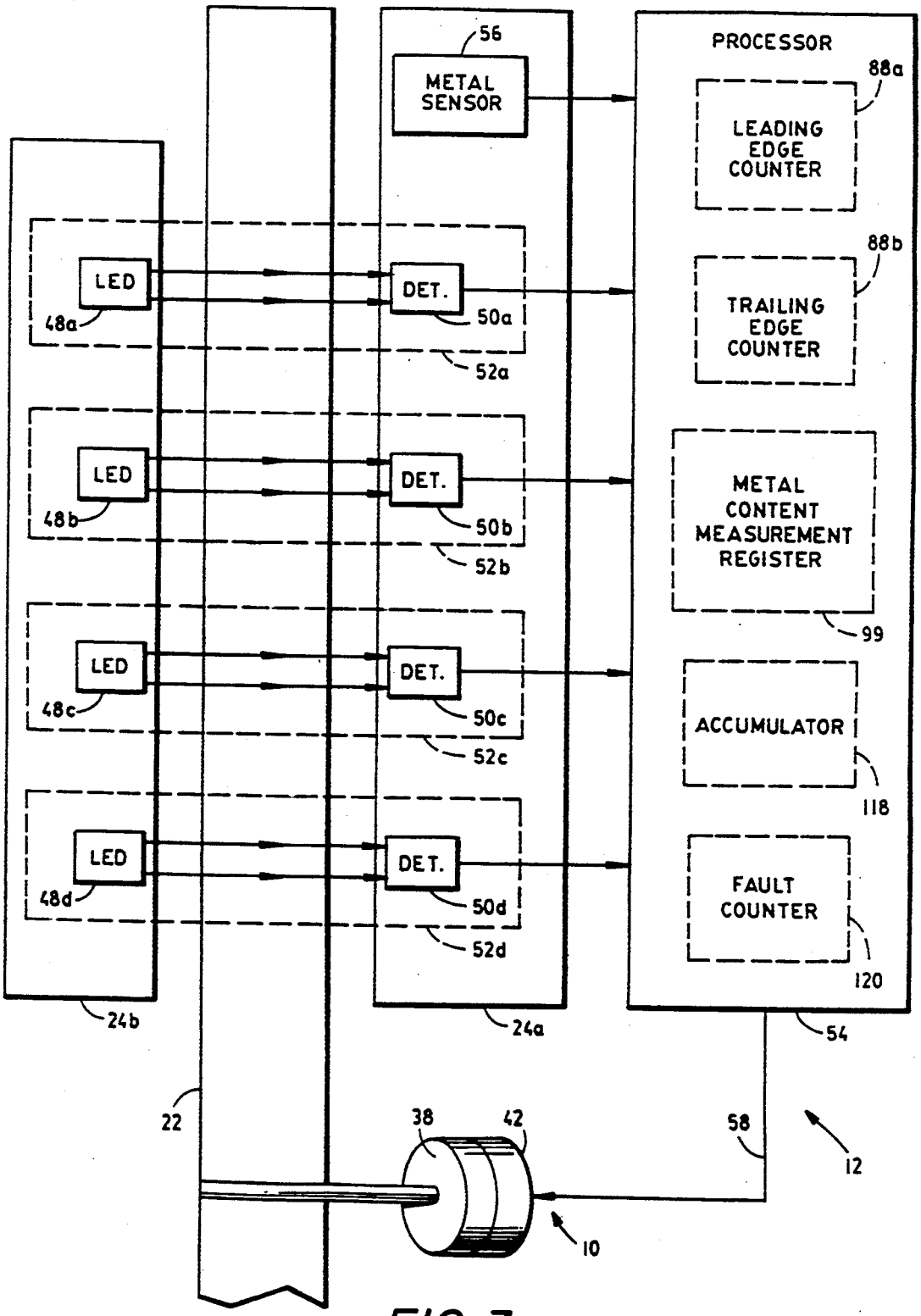
FIG. 3 is a simplified block diagram of a coin discrimination and collection system utilizing the coin transport mechanism of FIG. 1.

Referring to FIGS. 1 and 2, a coin transport mechanism 10 is adapted for use in a coin discrimination and collection system 12 as shown in FIG. 3. Coin transport mechanism 10 is here mounted within a security housing 14 such as would be used with coin operated laundry equipment. However, those of skill in the art will recognize that the coin discrimination and collection system 12 could be used in a variety of other applications such as vending machines, toll booths, and public telephones. Housing 14 here has front panel members 16*a–c* which form a coin slot 18 disposed at a suitable angle or tilt to align with a coin cavity or notch 20 in wheel or disk 22 which is at an angle as shown in FIG. 2. Disk 22 is sandwiched between upper and lower side plates 24*a* and *b* which are mounted in a stationary manner such as by bracket 26. A bearing 28 is mounted in lower side plate 24*b* and rotatably secures a shaft 30 which extends through and is secured to disk 22. The upper end 32 of shaft 30 extends through an aperture 34 in upper plate 24*a* and is connected to output shaft 36 of speed reducer 38 by a suitable coupling 40. Speed reducer 38 is driven by motor 42 which is suitably mounted such as by bracket 44. In operation in a manner to be described, actuation of motor 42 drives speed reducer 38 which rotates wheel or disk 22 and causes coin cavity or notch 20 to rotate about shaft 30 between stationary plates 24*a* and *b*. Coin notch 20 is rotated at a uniform angular velocity. In particular, uniform velocity is here provided by using a DC stepping motor 42 and pulsing at a high rate, here 600 pulses per second. With a relatively slow pulse rate, a stepper motor may start and stop thus resulting in ripple velocity. However, with a relatively high pulse rate such as 600 pulses per second, velocity ripple becomes negligible, and substantially constant velocity is attained. Here, a 30:1 speed reducer 38 is used to reduce the output speed of motor 42, so the 1800 RPM of the motor 42 is reduced to 60 RPM. Thus, for each pulse, disk 22 moves 0.6°.

Referring specifically to FIG. 1, wheel or disk 22 has inner and outer arcuate markers or masks 46*a* and *b* that have predetermined arcuate lengths and radial distances to control the operation of the coin transport mechanism 10 in a manner to be described later herein. Referring also to FIG. 2 and 3, lower plate 24*b* has four embedded light emitting devices, here LEDs 48*a–d*, which are disposed opposite corresponding light sensitive devices, here detectors 50*a–d*, that collectively form light sensors 52*a–d*. Even though upper and lower plates 24*a* and *b* are omitted from FIG. 1 for simplicity of illustration, the location of light sensors 52*a–c* and metal detector 56 which are embedded therein are shown. The locations of light sensors 52*a–d* will be discussed later herein with reference to the operation of coin transport mechanism 10. Each detector 50*a–d* has an output coupled to processor 54. A conventional metal sensor 56 such as described in U.S. Pat. No. 3,966,034 is also embedded in lower plate 24*a*, and has an output coupled to processor 54. Lower plate 24*b* in which metal sensor 56 is embedded is preferably a low friction material such as polystyrene. If plate 24*b* is metal, a plastic donut (not shown) preferably encases metal sensor 56 to avoid interference with the alternating field emanating therefrom. Processor 54 has an output 58 which provides high frequency pulses such as 600 pulses per second to motor 42 in accordance with operation to be described.

Still referring to FIG. 1, an upper guide 60 and a lower guide 62 have arcuate surfaces disposed adjacent to disk 22. Lower guide 62 extends rearwardly to coin collection slot 64 in a floor 66 of housing 14. A coin collection box 68 is disposed in a chamber 70 below coin collection slot 64. Front panel members 16*a–c* further form a coin return slot 72 with a coin return chute 74. Like coin insert slot 18, coin return slot 72 is angled or sloped to receive coins from disk 22 which is angled or tilted as shown in FIG. 2.

Figure 4A:
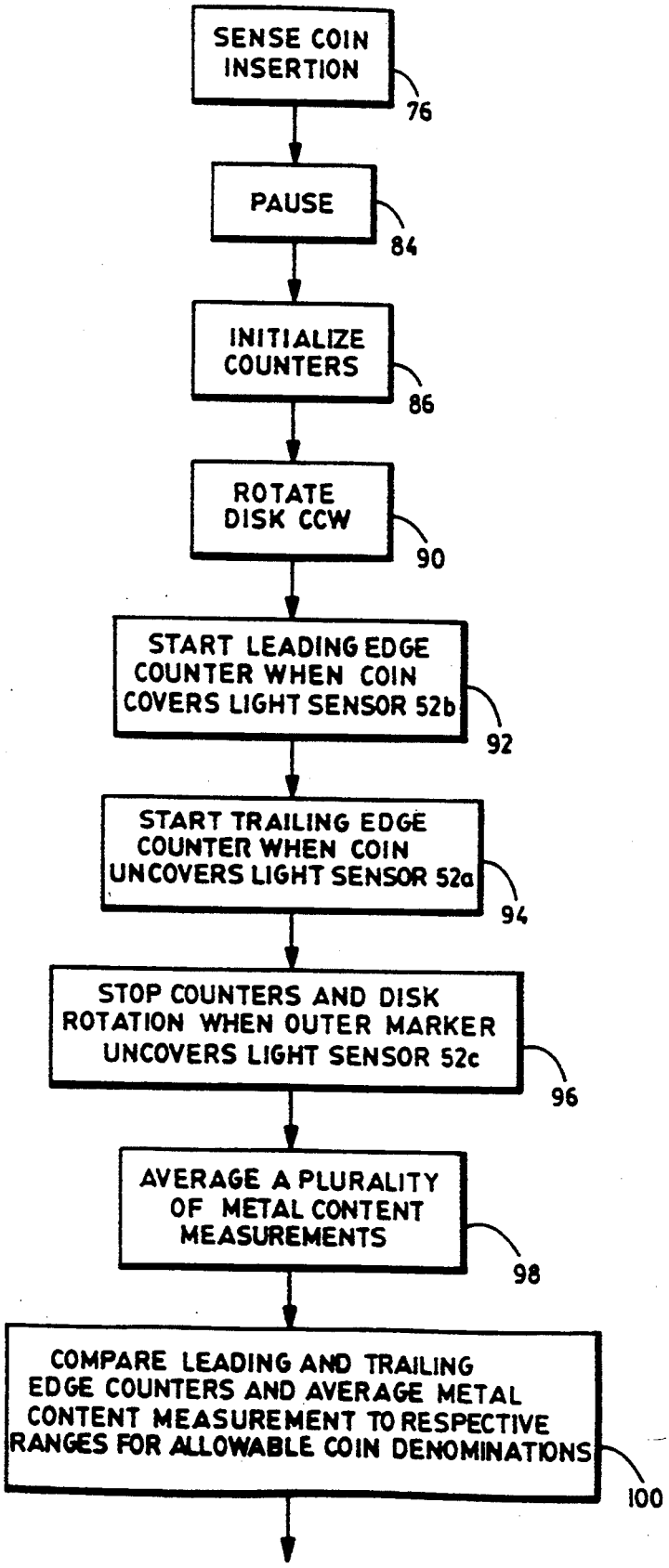
FIGS. 4A and 4B show a flow diagram depicting the operation of the coin discrimination and collection system.
Figure 5:
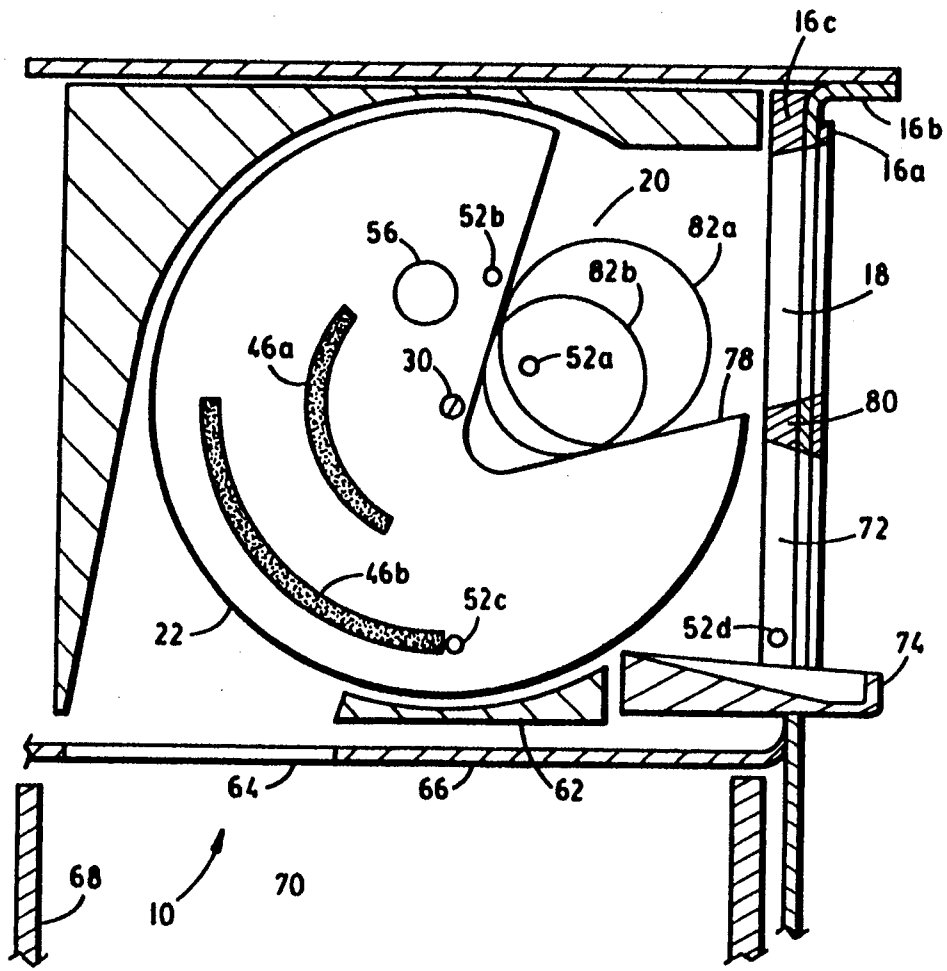
FIG. 5 is a side view of the coin transport mechanism after a coin has been received.

Referring to FIGS. 4A and B, the first step 76 in operation is to SENSE COIN INSERTION. Step 76 is performed using light sensor 52*a* as shown in FIG. 5. In particular, coin notch 20 is initially disposed to position edge 78 in alignment with the bottom 80 of coin insert slot 18, and light sensor 52*a* is disposed to transmit light from LED 48*a* across coin notch 20 to activate photo detector 50*a* when a coin is not present in coin notch 20. When a coin 82*a* or *b* is inserted by a user into coin insert slot 18, the coin 82*a* or *b* rolls down edge 78 and comes to rest in the nadir of notch 20 as shown in FIG. 5. Two coins 82*a* and *b* of different sizes or diameters are illustrated in FIG. 5 to show that light sensor 52*a* is disposed to be activated by coins of different sizes. In particular, a coin 82*a* or *b* breaks the light from LED 48*a* to photodetector 50*a*, and the change in state is interpreted by processor 54 to be that a coin 82*a* or *b* of unknown diameter has been inserted.

As shown in FIG. 4A, step 84 is to take a short PAUSE to permit the coin 82*a* or *b* to stop bouncing, and come to complete rest within coin notch 20 or pocket. Then, in step 86, processor 54 will INITIALIZE COUNTERS 88*a* and *b*. That is, leading and trailing edge time counters 88*a* and *b* as shown in FIG. 3 are reset to zero. As indicated by step 90, processor 54 then outputs 600 pulses per second on line output 58 to ROTATE DISK 22 CCW as referenced to FIG. 5. More specifically, while lower and upper plates 24*a* and *b* and embedded light sensors 52*a–d* remain stationary, disk 22 carrying coin 82*a* or *b* in coin notch 20 starts to rotate counterclockwise at a very uniform angular velocity.

Figure 6B:
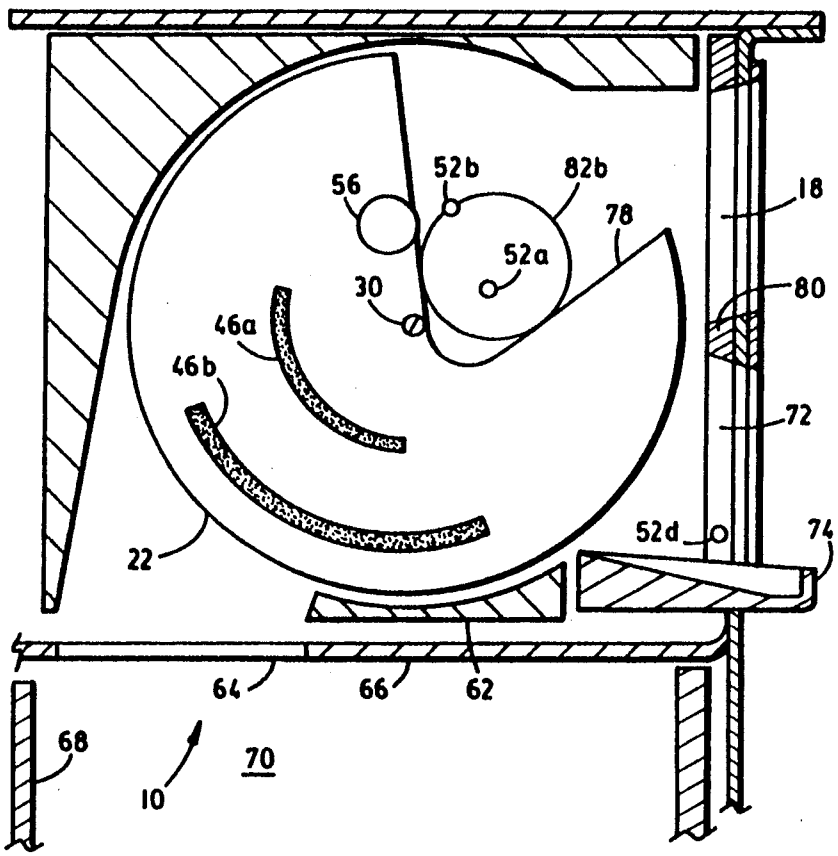
FIGS. 6A and 6B show angular rotations of the disk for two different denominations of coins, respectively.
Figure 6A:
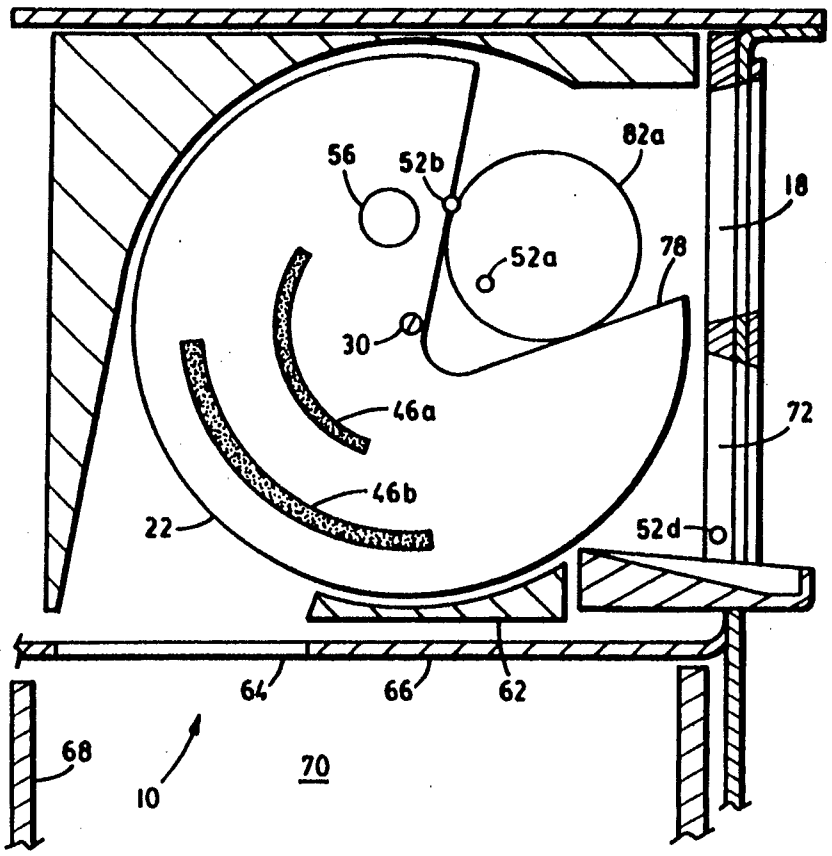

As indicated by step 92, processor 54 will START LEADING EDGE COUNTER 88*a* WHEN COIN COVERS LIGHT SENSOR 52*b*. In particular, wheel or disk 22 is made of a transparent material that permits light to be transmitted therethrough, so light from LED 48*b* activates photodetector 50*b* until the leading edge of a coin interrupts it. As shown by FIGS. 6A and 6B, the angular orientation of disk 22 when the leading edge of a coin arrives at light sensor 52*b* is a function of the size or diameter of the coin in notch 20. In particular, in FIG. 6A, coin 82*a* is relatively large, and the leading edge is detected by a change in state of photodetector 50*b* after only a relatively small rotation from the initial position as shown in FIG. 5. However, in FIG. 6B, coin 82*b* is relatively small and rests further down into the nadir of notch 20 thus permitting rotation of disk 22 through a larger angle before coin 82*b* breaks the transmission of light from LED 48*b* to photodetector 50*b*.

Referring to step 94 of FIG. 4A, processor 54 will then START TRAILING EDGE COUNTER 88*b* WHEN COIN UNCOVERS LIGHT SENSOR 52*a*. For example, as can be seen from FIGS. 6A and 6B, respective coins 82*a* and *b* cover light sensors 52*a*, and a separate trailing edge counter 88*b* is started when disk 22 rotates to an angular orientation where coins 82*a* or *b* no longer break the light path. As can be readily understood, the angular orientation of disk 22 when this occurs is also a function of the size, and more particularly the diameter, of the coin 82*a* or *b* in coin notch 20.

Figure 7:
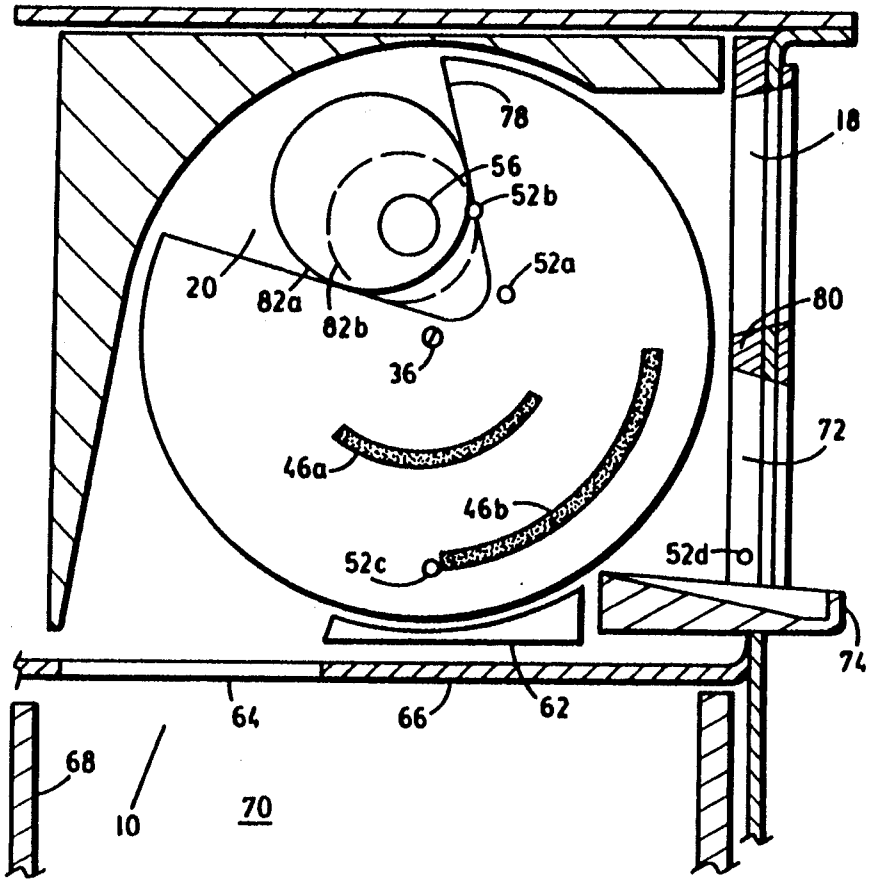
FIG. 7 shows the disk rotated to a coin evaluation orientation.

Referring again to FIG. 5, the initial angular orientation of disk 22 was determined by one end of outer marker 46*b* being aligned with light sensor 52*c* as shown. As indicated by step 96 of FIG. 4A, processor 54 will STOP COUNTERS 82*a* and *b* AND DISK 22 ROTATION WHEN OUTER MARKER 46*b* UNCOVERS LIGHT SENSOR 52*c*. Outer marker 46*b* is here an arcuate mask of 90°, so disk rotates 90° to the angular orientation shown in FIG. 7, at which time counters 88*a* and *b* are stopped. Thus, the contents of time counters 88*a* and *b* are elapsed time counts of the respective times to rotate disk 22 from respective positions or angular orientations where the leading and trailing edges of the coin 82*a* or *b* intersect light sensors 52*a* and *b* to a reference position, here 90° from the initial angular orientation. As described heretofore, the angular velocity of rotation is very uniform because it is accurately controlled by motor 42 at 0.6° per high frequency pulse from processor 54, so the counts in counters 88*a* and *b* also accurately represent the respective angular orientations of disk 22 when the leading and trailing edges of the coin 82*a* or *b* arrive at or intersect respective light sensors 52*a* and *b*. Furthermore, the angular orientation of disk 22 when leading and trailing edges of coin 82*a* or *b* intersect respective light sensors 52*a* and *b* is a function of the size, or more particularly the diameter, of coin 82*a* or *b*. Thus, the respective elapsed time counts in leading and trailing edge counters 88*a* and *b* accurately represent or correspond to the diameters of the coin 82*a* or *b* in coin notch 20 of disk 22. For example, with 600 pulses per second and each pulse rotating wheel 22 through an arc of 0.6°, wheel 22 would rotate at 1 revolution per second, or 0.25 seconds between the initial orientation as shown in FIG. 5 and the reference or evaluation orientation as shown in FIG. 7. In one operative embodiment, light sensor 52*b* may be positioned such that it is intersected by the leading edge of a dime at 143 milliseconds into the movement between orientations of FIG. 5 and FIG. 7, so the elapsed time count in leading edge counter 88*a* would be 107 milliseconds which, as described heretofore, corresponds to the diameter of the dime. In a similar manner, light sensor 52*a* may be positioned such that it is intersected by the trailing edge of a dime at 183 milliseconds into the movement, so trailing edge counter 88*b* would be 67 milliseconds. Likewise, typical counts in leading and trailing edge counters 88*a* and *b* for a nickel may be 140 and 87 milliseconds, respectively, and typical counts for a quarter may be 187 and 117 milliseconds, respectively. As will be described later herein, the actual measured times which correspond to the diameter of the coin 82*a* or *b* are compared to a known or standard range of acceptable times for each denomination of coin in use.

Although the use of elapsed time counters 88*a* and *b* has been described, those of skill in the art will recognize that there are other ways to provide signals indicative of the angular orientation of disk 22 at the time the leading and trailing edges of a coin 82*a* or *b* arrive at the light sensors 52*a* and *b*. For example, a mechanical resolver could be used to obtain angular orientation measurements. Also, rather than operating to a reference point, here the angular orientation of FIG. 7, a counter could be started by a leading edge and stopped by a trailing edge.

As indicated by step 98 of FIG. 4A, processor 54 will next AVERAGE A PLURALITY OF METAL CONTENT MEASUREMENTS, and store the result in metal content measurement register 99 (FIG. 3). As can be seen from FIG. 7, metal sensor 56 is positioned to be covered or adjacent to any sized coin 82*a* or *b* after disk 22 has been rotated through a predetermined angle, here 90°, from the initial orientation. Disk 22 and lower plate 24*a* are sloped or angled as shown best in FIG. 2 so coin 82*a* or *b* will be substantially flush against or parallel to metal sensor 56. Metal sensor 56 is a conventional metal content sensor such as one that positions the coin 82*a* or *b* in an inductive field of a coil in a circuit (not shown), and measures the coin's effect on the frequency, phase, or amplitude of the circuit's output. As is well known, the change in the measured parameter is, in part, a function of the metal content of the coin 82*a*. In contrast with prior art metal sensors techniques where the coin is rolled through the field, coin 82*a* is here stationary when a metal measurement is conducted. Thus, irregularities or inconsistencies caused by motion of the coin 82*a* are eliminated. Further, because disk 22 is accurately positioned by the end of marker 46*b* and light sensor 52*c*, approximately the same relationship always exits between the metal sensor 56 such as an inductor coil and coins 82*a* or *b* of a particular denomination.

As indicated by step 100 in FIG. 4A, processor 54 will then COMPARE LEADING AND TRAILING EDGE COUNTERS 88*a* and *b* AND AVERAGE METAL CONTENT MEASUREMENT TO RESPECTIVE RANGES FOR ALLOWABLE COIN DENOMINATIONS. There may be a variety of reasons why coins of the same denomination may result in slightly different leading and trailing edge measurements, and also different metal content measurements. For example, with respect to measured times, there may be slight variations in the alignment of or how the light sensors 52*a* and *b* are switched from one state to the other, or where the disk 22 is stopped by lower marker 46*b* and light sensor 52*c*. Further, there may be slight variations in the angular velocity of disk 22, or even in the diameters of like coins. With respect to metal content measurements, circuit parameters may vary, or coins may be worn or dirty, or may even have slightly different metal contents. In order to allow for variances in these parameters and others, acceptable ranges are formulated for each coin denomination that is allowed. These ranges may generally be formulated by sampling the measured leading and trailing edges times for a large number of coins of like denomination under a variety of conditions using different coin transport mechanisms 10. From this data, acceptable ranges may be determined using conventional statistical principles. For example, the range for leading and trailing edge counter times may typically be plus or minus 0.5 or 1 millisecond from the times given above for various denominations. In short, established limits of acceptability may generally be determined and stored such as in a look-up table for comparison with real time measurements of coin characteristics.

Figure 4B:
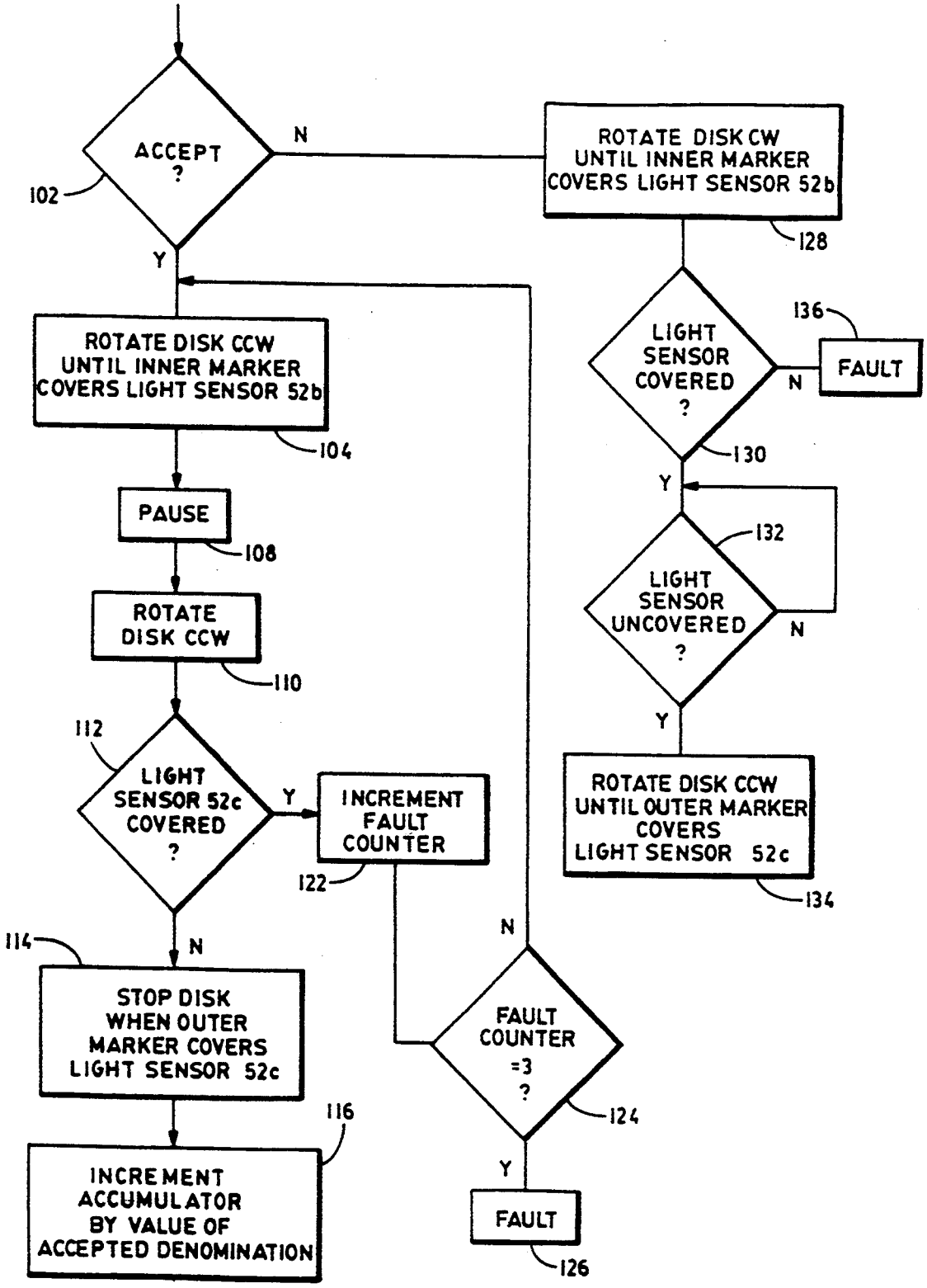

As indicated by step 102 as shown in FIG. 4B, processor 54 will then determine whether to ACCEPT ? or reject the coin 82*a* or *b* at the evaluation position shown in FIG. 7. Although a variety of algorithms may be used, processor 54 here merely determines if the stored elapsed time counts of the leading and trailing edge counters 88*a* and *b* are in the respective preprogrammed ranges for these parameters, and if the average metal content measurement falls in its preprogrammed range. If all three conditions are satisfied for a particular denomination of coin, the coin 82*a* or *b* is accepted for that denomination; and if any of the three conditions is not met for a particular denomination of coin, the coin 82*a* or *b* is rejected.

Figure 8:
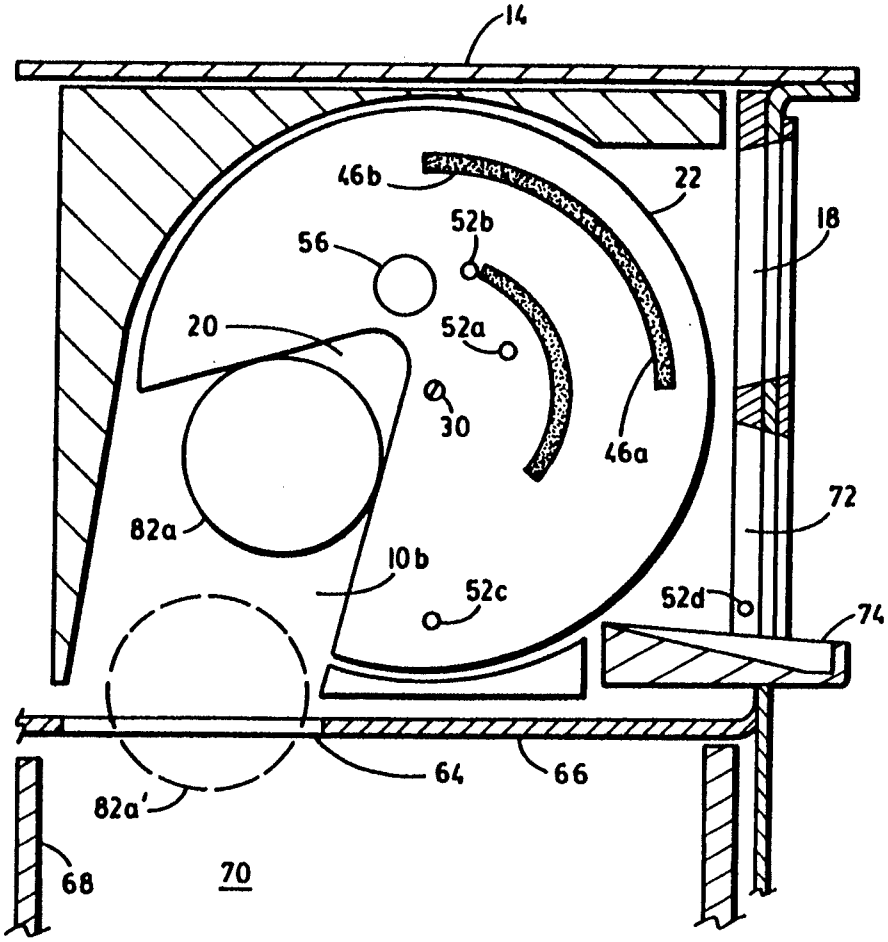
FIG. 8 shows the disk rotated to a coin collection orientation.

If the coin matches the parameters or characteristics (i.e. falls in the three ranges) of a particular coin denomination, processor 54 will ROTATE DISK 22 CCW UNTIL INNER MARKER 46*a* COVERS LIGHT SENSOR 52*b* as indicated by step 104 in FIG. 4B. More specifically, as shown in FIG. 8, disk 22 is rotated counterclockwise, here approximately 90°, to position the opening 106 of notch 20 facing downwardly above coin collection slot 64. In such position, processor 54 stops disk 22, and the coin 82*a* which has been accepted, falls to position 82*a'* down through coin collection slot 64 into coin collection box 68. After a suitable PAUSE as shown by step 108, processor 54 will ROTATE DISK 22 CCW as indicated by step 110.

As shown in FIG. 8, light sensor 52*c* is disposed to sense a lower portion of disk 22 in the CCW path of coin notch 20 in FIG. 8 and the initial orientation shown in FIG. 1. During the rotation of disk 22 in a CCW direction back to the initial position, processor 54 monitors light sensor 52*c* to determine if LIGHT SENSOR 52*c* COVERED ? as indicated by step 112. That is, processor 54 monitors for a change of state caused by a nontransparent object passing between LED 48*c* and photodetector 50*c*. If there is no such state change, processor 54 will STOP DISK 22 WHEN OUTER MARKER 46*b* COVERS LIGHT SENSOR 52*c* as indicated by step 114. Simply stated, disk 22 is returned to its initial orientation ready for insertion of another coin, and processor 54 will INCREMENT ACCUMULATOR 118 BY VALUE OF ACCEPTED DENOMINATION as indicated by step 116 in FIG. 4B. As is readily understood, an accumulator 118 is used to total the value of coins inserted towards a final value that is sufficient to activate the controlled machine, whether it be laundry equipment or a vending machine or the like.

Still referring to FIG. 4B, if light sensor 52*c* is covered during the rotation of disk 22 back to the initial orientation as indicated by step 112, that is indicative that the accepted coin 82*a* or *b* is still present in the coin notch 20. For example, such condition may have existed because a sticky substance was deposited on the edge of coin 82*a* or *b*. Without step 112, the process beginning with step 76 would continue in a loop and accumulator 118 would continue to increment with the coin 82*a* or *b* being lodged in notch 20. However, if an accepted coin 82*a* or *b* is not collected through coin collection slot 64 and continues to be present in coin notch 20, processor 54 will INCREMENT FAULT COUNTER 120 as indicated by step 122. As indicated by step 124, processor 54 will determine if FAULT COUNTER=3? If not, processor 54 will repeat steps 104, 108, 110 and 112 to determine if the jammed coin 82*a* or *b* subsequently becomes dislodged and drops through coin collection slot 64. If the coin 82*a* or *b* remains lodged in coin notch 20 such that fault counter 120 increments to 3, processor 54 will enter a FAULT mode as indicated by step 126. Suitable action may be taken, but coin transport mechanism 10 would generally be inoperable until service is provided to remove coin 82*a* or *b* from coin notch 20. It is noted that light sensors may perform more than one function. For example, light sensor 52*c* is used in conjunction with marker 46*b* to angularly locate disk 22, and also operates to sense the presence of coins 82*a* and *b*. In this respect, light sensor 52*c* must be located in a manner to perform both of these functions for all acceptable sizes of coins.

Figure 9:
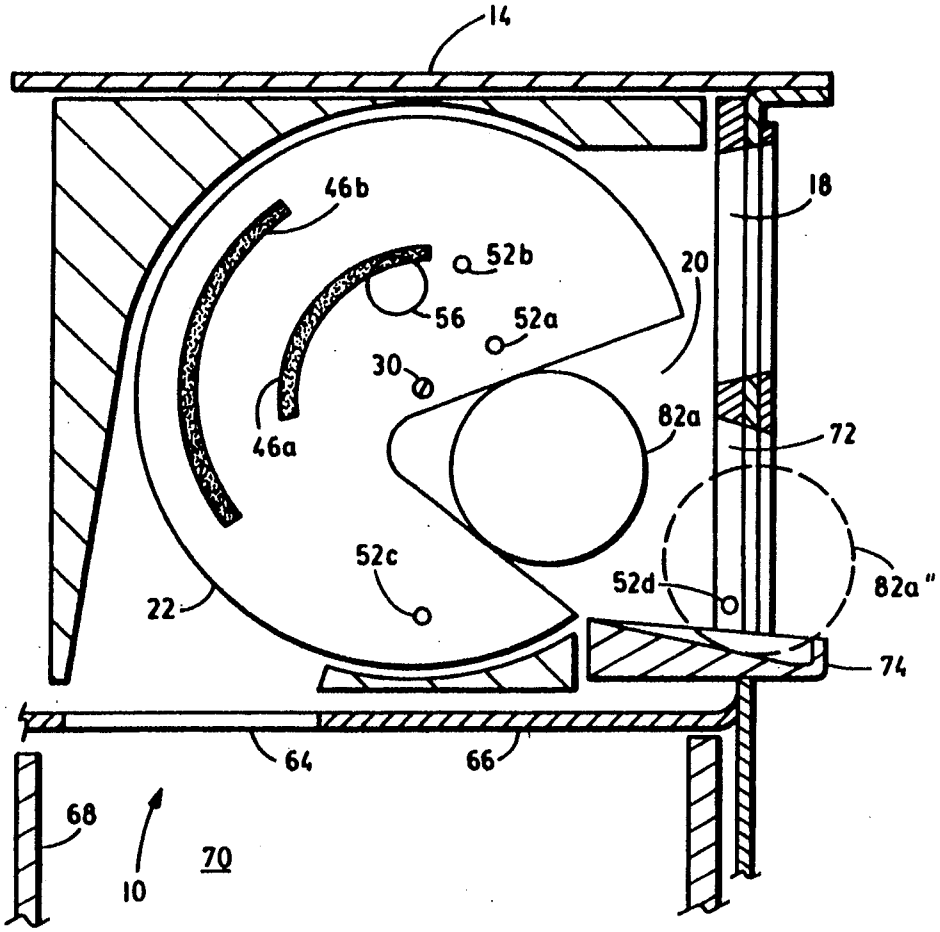
FIG. 9 shows the disk rotated to a coin return orientation.

Referring again to step 102, processor 54 will ROTATE DISK 22 CW UNTIL INNER MARKER 46*a* COVERS LIGHT SENSOR 52*b* as indicated by step 128 if the coin 82*a* or *b* is not accepted. Under such conditions, the disk 22 is rotated to the position shown in FIG. 9. Thus, the coin 82*a* is free to roll down edge 78 and coin return chute 74 through coin return slot 72 to position 82*a''*. Light sensor 52*d* is disposed in coin return slot 72 as shown, and processor 54 will determine if LIGHT SENSOR 52*d* COVERED ? as indicated by step 130. If it is covered, that is indicative that the coin 82*a* has rolled out of coin notch 20 to coin return chute 74, and processor 54 will then determine if LIGHT SENSOR 52*d* UNCOVERED ? as indicated by step 132. Such change of state of light sensor 52*d* would indicate that the user has removed the coin 82*a''*, in which case processor 54 will ROTATE DISK 22 CCW UNTIL OUTER MARKER COVERS LIGHT SENSOR 52*c* as indicated by step 134. In short, such action would return the disk 22 to its initial operating orientation ready for insertion of another coin.

Referring again to step 130, processor 54 would indicate a FAULT as shown by step 136 if the coin 82*a* was not sensed as being returned. Disk 22 will remain is this position until coin 82*a* or *b* is removed. As discussed above, such condition could indicate that the coin 82*a* is lodged in coin notch 20 in which case service may be required. Further, if the coin 82*a* or *b* is not sensed as having been removed by the user is step 132, a loop will be executed until such action occurs.

Referring again to FIGS. 1 and 5–7, edge 78 of notch 20 is curved. In particular, edge 78 is the driving edge that pushes coin 82*a* or *b* through an arcuate path between the angular orientations of FIG. 1 and FIG. 7, and edge 78 is here shaped to be substantially perpendicular to the desired direction of coin travel. Thus, there is no force component due to tangential coin acceleration that pushes the coin 82*a* or *b* outward from the center of disk 22. Therefore, the coin 82*a* or *b* does not move in notch 20 when the disk 22 accelerates up to speed. Further, the angle or shape of edge 78 exceeds a minimum angle to provide an inward force component that offsets or counteracts the centripetal acceleration of the coin 82*a* or *b* up to a speed such as 60 R. P. M.

Hence, when a coin 82*a* or *b* is accelerated up to speed or at steady state, the coin 82*a* or *b* does not move in notch 20. That is, coin 82*a* or *b* has a fixed relationship with respect to disk 22 during the portion of time when diameter is being discriminated, and the velocity of coin 82*a* or *b* is accurately controlled along a predetermined arcuate path from the orientation of FIG. 5 to the orientation of FIG. 7. The path passes light sensors 52*a* and *b*.

Figure 10:
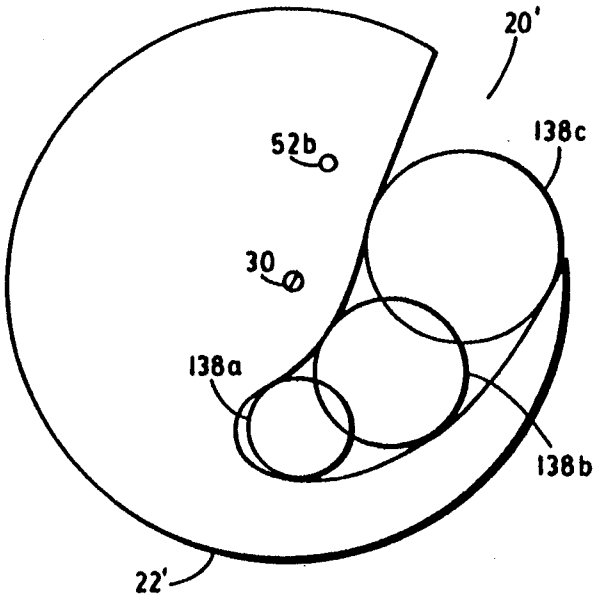
FIG. 10 shows an alternate embodiment for the disk.

The geometry or shape of notch 20 can also be selected to provide another advantage in diameter related measurements. In particular, see FIG. 5 and note that a center for a smaller coin 82*b* is located lower in the notch 20 than a larger coin 82*a*. This displacement difference contributes to the fact that the larger coin 82*a* arrives at light sensor 52*b* sooner than a small coin 82*b* when disk 22 is rotated. See FIGS. 6A and 6B for the respective angular orientations of leading edge arrival. The difference between these two angular orientations represents the diameter discrimination of coins. Referring now to FIG. 10, it can be seen that notch 20' is shaped such that a small coin 138*a* falls much further into the notch 20' than a larger coin 138*b* or *c*. Thus, there is a larger or increased angular difference between the arrival of a large coin 138*c* and a small coin 138*a* at light sensor 52*b*. Thus, a mechanical advantage in displacement of coins of different sizes within the notch 20' is provided. That is, there is nonlinear displacement of coins of different sizes within the notch 20' to amplify the difference between measurements of those sizes.

As described above, two coin diameter related measurements are made. The first measurement is stored in leading edge counter 88*a*, and is the elapsed time between the leading edge of the coin 82*a* or *b* intersecting or arriving at light sensor 52*b* and disk 22 arriving at the reference or evaluation orientation shown in FIG. 7. The second measurement is stored in trailing edge counter 88*b*, and is the elapsed time between the trailing edge of the coin 82*a* or *b* intersecting or arriving at light sensor 52*a* and disk 22 arriving at the reference or evaluation orientation shown in FIG. 7. It is noted that the reference point for stopping the counters 88*a* and *b* is the same for both measurements. Two diameter measurements may be more desirable than one because the leading edge measurement with light sensor 52*b* may tend to be more accurate for small diameter coins 82*b*, while the trailing edge measurement using light sensor 52*a* may tend to be more accurate for large coins 82*a*.

In summary, a number of advantages are provided by coin transport mechanism 10 and related apparatus and method. First, coin transport mechanism 10 carries a coin 82*a* or *b* at an accurately controlled velocity along a path where diameter related measurements are made without inconsistencies caused by a rolling coin. Also, coin transport mechanism 10 positions the coin 82*a* or *b* in a repeatable and accurately controlled stationary position adjacent to the metal sensor 56 so a plurality of accurate metal content measurements are made. Further, in all but the initial angular orientation of disk 22 as shown in FIG. 5, the periphery of disk 22 covers the coin insert slot 18 which prevents additional coins or implements from be inserted into and interfering with the coin evaluation process. Also, after a coin has been accepted because its characteristics match that of a known standard, the coin 82*a* or *b* is rotated so that the coin is collected. However, if the coin remains in notch 20 such as it might if a sticky substance had been placed on the coin 82*a* or *b* to cheat the system 12, that is detected by light sensor 52*c*, and no credit is given.

This completes the Description of the Preferred Embodiment. However, a reading of it by those skilled in the art will bring to mind many alterations and modifications that do not depart from the spirit and scope of the invention. Therefore, it is intended that the scope of the invention be limited only by the appended claims.

What is claimed is:

1. Coin discriminating and collection apparatus comprising:

a rotary disk having a notch adapted in an initial angular orientation for receiving a coin inserted by a user;

means for rotating the disk in a first direction through a predetermined arc;

means for accepting or rejecting the coin;

means responsive to acceptance of the coin for rotating the disk in the first direction to an angular orientation where the notch opens downwardly above a coin collection path to enable the coin to fall into a coin collection box; and means responsive to rejection of the coin for rotating the disk in a direction opposite the first direction to an angular orientation where the notch opens downwardly above a coin return chute to enable the coin to fall into the chute to be returned to the user.

2. The apparatus recited in claim 1 wherein said accepting or rejecting means comprises:

means for providing a signal corresponding to the diameter of the coin; and means for comparing the diameter corresponding signal to a range of corresponding signals representative of acceptable coins and, in response thereto, for determining whether to accept or reject the inserted coin.

3. The apparatus recited in claim 1 further comprising means for providing a signal corresponding to the metal content of the inserted coin.

4. The apparatus recited in claim 3 wherein said comparing means comprises comparing said metal content signal to a range of corresponding signals representative of acceptable coins and, in response thereto, for determining whether to accept or reject the inserted coin.

5. The apparatus recited in claim 1 further comprising means for rotating the disk from the angular orientation where the notch is above the coin collection path back to the initial angular orientation and for detecting whether the inserted coin is still disposed in the notch during the rotation.

6. The apparatus recited in claim 5 further comprising means responsive to detection of the inserted coin in the notch during rotation back to the initial angular orientation for interrupting said rotation and rotating the disk back to the angular orientation where the notch opens downwardly above the coin collection path.

7. The apparatus recited in claim 6 for again attempting to rotate the disk back to the initial orientation, and for indicating a fault if the inserted coin is again detected in the notch.

8. The apparatus recited in claim 1 further comprising means for detecting removal of the inserted coin from the coin return chute by the user and, in response thereto, for returning the disk to the initial angular orientation.

9. Coin discriminating and collection apparatus comprising:

a rotary disk having a notch adapted in an initial angular orientation for receiving a coin inserted by a user;

a motor coupled to the rotary disk;

a first sensor disposed adjacent the disk to detect the presence of an inserted coin;

a controller arranged to receive from the first sensor a signal indicating insertion of a coin and, in response thereto, to rotate the disk in a first direction through a predetermined arc;

a timer arranged to provide a count corresponding to the diameter of the coin;

said controller comprising a comparator for comparing the diameter corresponding count to a range of corresponding values representative of acceptable coins;

said controller deciding whether to accept or reject the inserted coin in response to the comparator;

said controller rotating the disk in the first direction to an angular orientation where the notch opens downwardly above a coin collection path to enable the coin to fall into a coin collection box if the inserted coin is accepted; and said controller rotating the disk in a direction opposite the first direction to an angular orientation where the notch opens downwardly above a coin return chute to enable the coin to fall into the chute to be returned to the user if the inserted coin is rejected.

10. The apparatus recited in claim 9 further comprising a metal content sensor disposed to provide a signal corresponding to the metal content of an inserted coin, the controller further comprising a second comparator for comparing measured metal content of the inserted coin to a range of corresponding values representative of acceptable coins wherein the controller further decides whether to accept or reject the inserted coin based on the second comparator.

11. The apparatus recited in claim 9 wherein said controller is responsive to optical detection of arcuate markers on the disk to determine when the disk is in the initial angular orientation or in an angular orientations such that the notch opens downwardly above the coin collection path and the coin return chute.

12. The apparatus recited in claim 9 wherein said controller rotates the disk from the angular orientation where the notch is above the coin collection path back to the initial orientation, and detects whether the inserted coin is still disposed in the notch.

13. The apparatus recited in claim 12 wherein the controller discontinues rotation of the disk back to the initial orientation in response to detection of the inserted coin in the notch.

14. A method of discriminating and collecting coins, comprising the steps of:

receiving a coin inserted by a user into a notch of a rotary disk;

rotating the disk in a first direction through a predetermined arc;

providing a signal corresponding to the diameter of the coin;

comparing the diameter corresponding signal to a range of corresponding signals representative of acceptable coins and, in response thereto, determining whether to accept or reject the inserted coin;

rotating the disk in the first direction to an angular orientation where the notch opens downwardly above a coin collection path to enable the coin to fall into a coin collection box if the coin is accepted; and rotating the disk in a direction opposite the first direction to an angular orientation where the notch opens downwardly above a coin return chute to enable the coin to fall into the chute to be returned to the user if the coin is rejected.

15. The method recited in claim 14 wherein said predetermined arc is approximately 90°.

16. The method recited in claim 14 further comprising a step of providing a signal corresponding to the metal content of the inserted coin.

17. The method recited in claim 16 wherein the comparing step comprises a step of comparing said metal content signal to a range of corresponding signals representative of acceptable coins and, in further response thereto, determining whether to accept or reject the inserted coin.

18. The method recited in claim 14 further comprising a step of rotating the disk from the angular orientation where the notch is above the coin collection path back to the initial angular orientation and detecting whether the inserted coin is still disposed in the notch during the rotation.

19. The method recited in claim 18 further comprising a step of interrupting said rotation back to the initial orientation and rotating the disk back to the angular orientation where the notch opens downwardly above the coin collection path if the inserted coin is detected in the notch during rotation back to the initial angular orientation.

20. The method recited in claim 19 further comprising steps of again attempting to rotate the disk back to the initial orientation, and indicating a fault if the inserted coin is again detected in the notch.

* * * * *